United States Patent [19]

Hart et al.

[11] 4,212,252

[45] Jul. 15, 1980

[54] GONDOLA-TYPE RAILWAY CAR

[75] Inventors: James D. Hart, Grove City; Joseph C. Lightner, Greenville, both of Pa.

[73] Assignee: Greenville Steel Car Co., Greenville, Pa.

[21] Appl. No.: 874,616

[22] Filed: Feb. 2, 1978

[51] Int. Cl.[2] ..... B61D 7/00; B61D 17/00

[52] U.S. Cl. ..... 105/406 R

[58] Field of Search ..... 105/406 R, 406 A, 282 R, 105/416, 419, 245, 254

[56] References Cited

U.S. PATENT DOCUMENTS

| | | | |
|---|---|---|---|
| 719,868 | 2/1903 | Randel | 105/282 |
| 1,627,256 | 5/1927 | Smith | 105/282 R |
| 3,240,168 | 3/1966 | Charles et al. | 105/406 R |
| 3,713,400 | 1/1973 | Teoli | 105/422 |
| 3,918,370 | 11/1975 | Campbell et al. | 105/416 |

FOREIGN PATENT DOCUMENTS

| | | | |
|---|---|---|---|
| 410371 | 3/1925 | Fed. Rep. of Germany | 105/406 R |

*Primary Examiner*—Barry L. Kelmachter

*Attorney, Agent, or Firm*—Webb, Burden, Robinson & Webb

[57] ABSTRACT

A gondola-type railway car has a bottom which comprises at least one and preferably at least two transversely parabolic surfaces which extend below the side sills of the car, giving increased capacity, a lower center of gravity, and increased resistance to bottom damage.

5 Claims, 2 Drawing Figures

GONDOLA-TYPE RAILWAY CAR

FIELD OF THE INVENTION

This invention relates to railway cars and more particularly to bulk commodity carrying gondola cars of the type which include generally open tops and fixed sides and floors and are unloaded by rotary car dumpers.

DESCRIPTION OF THE PRIOR ART

Gondola cars are used to carry bulky material, such as coal or scrap steel, although less dense commodities are also transported via gondolas. Like all railroad cars used in the United States, gondolas must conform to the Car Clearance Profile Dimensions as established by the Association of American Railroads (AAR). These dimensions set forth the maximum allowable half-widths for a railway car, from a vertical center line, for a given elevation above the rail. Gondolas built to be unloaded by rotary car dumpers have additional restrictions placed on their dimensions. The AAR has established a requirement that these gondolas must be capable of passing over a vertical convexity having a radius of 300 feet, taken in a plane parallel to the length of the car, as specified in its manual, *Specifications for Design, Fabrication, and Construction of Freight Cars,* Section 2.1.4.3.2. "Cars Uncoupled."

The first gondola cars had a continuous center sill structure extending the length of the car which limited the capacity of the car and kept the payload above the trucks, resulting in a car with a high center of gravity and low stability.

In order to increase the load capacity of the gondola and lower its center of gravity, the floor was lowered to utilize the space between the trucks and below the side sills. A second generation of cars was built in which the single center sill was replaced by two stub sills, each located above a truck. In an early version, the flat floor of the gondola was replaced by a trough-shaped floor having downward sloping sides and ends. In U.S. Pat. No. 3,240,168, issued Mar. 15, 1966 to A. F. Charles et al., for example, a gondola car is described having stub sills and a trough-shaped bottom. In order to provide support for the trough-shaped bottom, it was necessary to add tubular stiffeners along the outside of the trough in a transverse direction. However, the presence of these tranverse stiffeners restricts the depth the trough may reach and still have the car meet the AAR ground clearance requirements for cars to be unloaded by rotary car dumpers.

Subsequently, a gondola was developed in which the floor was dropped below the side sills and between the trucks and was curved about the central longitudinal axis of the car so that a transverse cross-section of the car taken between the trucks revealed a floor having a parabolic shape. In U.S. Pat. No. 3,713,400, issued Jan. 30, 1973 to Anthony Teoli, for example, a gondola car is described having a bottom plate of parabolic shape extending down between the wheel assemblies and free of external and internal reinforcements. By giving the floor a parabolic shape, the columnar load was translated to tensile stresses borne by the side sills. This eliminated the need for transverse external reinforcing so that the floor could be lowered even further, resulting in a lower center of gravity and a larger load capacity. However, the longitudinally parabolic shape of the floor does not use the space below the side sills efficiently since it does not approximate closely the AAR Car Clearance Profile. In addition, no portion of the floor may drop below the apex of the arc having a 300 foot radius which establishes the minimum ground clearance for cars to be used by rotary car dumpers mentioned above. A further disadvantage of this type of bottom is that the entire length of the longitudinally parabolic bottom, having the same clearance, is susceptible to damage.

SUMMARY OF THE INVENTION

This invention is a gondola car having a transversely parallel bottom instead of a longitudinally parabolic one. Similar to the longitudinally parabolic bottom, the transversely parabolic bottom translates the vertical columnar stress of the load to horizontal tensile stresses which are borne by the ends of the gondola. However, the transversely parabolic bottom more closely approximates the maximum AAR Car Clearance Profile Dimensions and the minimum ground clearance required for gondolas to be unloaded by rotary car dumpers. As a result of this more efficient use of space between trucks and the side sills, use of this invention results in a gondola with a greater load capacity for a given length between truck centers and width, a lower center of gravity for better stability, and a lesser susceptibility to bottom damage than prior art gondolas.

This invention is a gondola-type railway car having a bottom which comprises at least one and preferably at least two transversely parabolic surfaces which extend below the side sills of the car.

DESCRIPTION OF PREFERRED EMBODIMENTS

Figure 1:
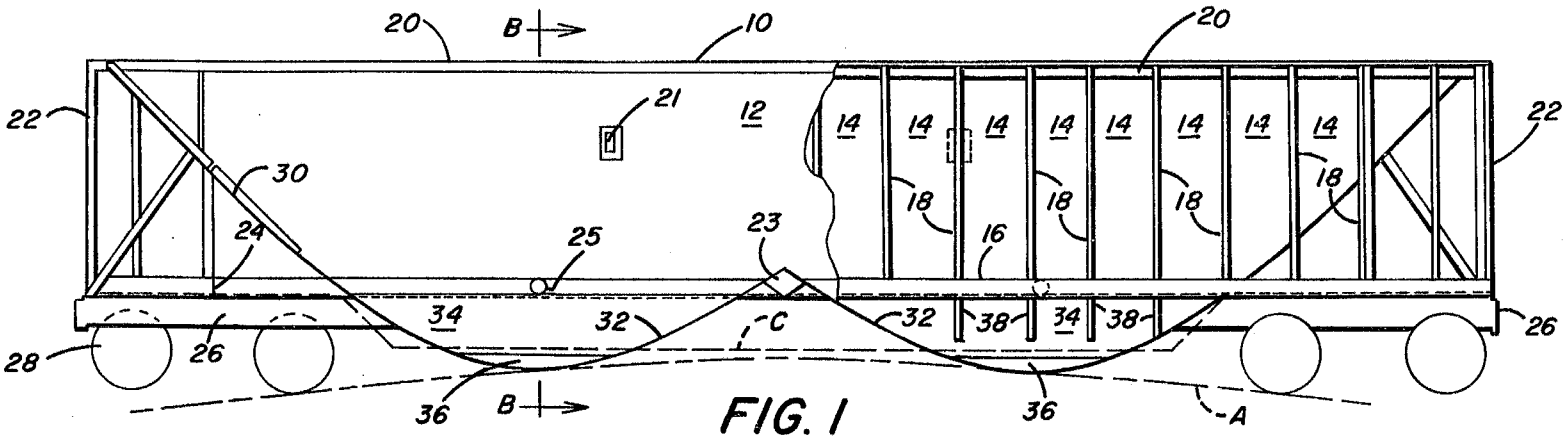
FIG. 1 is a half-section side elevation of a gondola having a double transversely parabolic bottom.

The gongola car, generally designated 10, comprises an upper body 12 of standard construction and includes side panels 14 extending upward from box section side sills 16, FIG. 1. Center stub sills (not shown) are provided at opposite ends of the car 10. A center sill may be incorporated into the car, although such a center sill would extend through the lading area. Side stiffeners 18 are attached to and spaced longitudinally along the box section side sills 16 and extend upward to form an external support for the side panels 14. Side shapes 20 extend the length of the gondola 10 and are attached to the top of the side stiffeners 18. Side ties 21 are attached to spaced intervals to the side panels 14 adjacent to the side stiffeners 18 to prevent lateral movement of the side panels. Likewise, tubular side sill ties 25 extend transversely between the side sills 16 to prevent lateral movement of the side sills. A transverse center cross ridge support member 23 is welded to the side panels 14 at a point near the side sills 16 and substantially midway of the car length. Cross ridge 23 which extends across the car is generally diamond shaped in cross section for reasons to be described hereinafter.

At each end of the gondola 10, the side sills 16 and center sill (not shown) are seated upon a body bolster 24 which rests on the truck assembly 26 which includes the wheels 28 and axles (not shown). Corner posts 22 connect between the side sills 16 and side shapes 20. Car end plates 30 which extend at approximately 45 degrees to the horizontal are connected at each end of the car to the side shapes 20 and the side sills 16 and are reinforced in a standard manner. These end plates can actually vary from a horizontal position to a vertical position depending on the space and strength requirements of the car ends.

Below the side sills 16 two bottom sheets 32, each in the form of a parabolic curve, are welded to the respective end sheet 30 and the cross ridge member 23. At one end, the diagonal cross section of member 23 provides a smooth transition and connection for the sloping surface of bottom sheet 32 and the same smooth transition and connection is provided at the other end by the sloping end plate 30. While two parabolic sheets form the preferred embodiment, it will be recognized that a single sheet or a plurality of sheets could be used in conjunction with gondola cars of various sizes and shapes. For example, a single bottom would be used on a car having short truck centers whereas more than two bottom sheets could be used for a plurality of compartments such as used to haul wood chips or other less dense lading. The space below the side sills 16 is enclosed by vertical wall members 34, which are welded to the inside face of the side sills, and bevel members 36 which are located between the wall members 34 and the bottom sheets 32. The bevel members 36 permit the volume to be maximized by closely following the allowable clearance line, see FIG. 2. In order to prevent lateral movement of the wall members 34, lower side stiffeners 38 are welded to the side sill 16 and to the contiguous wall member and are spaced at regular intervals along the wall member.

One advantage of the transversely parabolic bottom over the longitudinally parabolic bottom of the prior art is shown in FIG. 1. Line A represents the minimum ground clearance requirements for cars to be unloaded by rotary car dumpers as established by the AAR. Line C represents the minimum ground clearance attainable by a gondola having a longitudinally parabolic bottom and is approximately 13 inches above the rail. The transversely parabolic bottom sheets 32 can be formed to drop to 10 inches above the rail, which is below line C yet above line A, thus lowering the center of gravity of the gondola but still conforming to AAR standards. In addition, only the lowermost portion of each transversely parabolic bottom sheet is susceptible to bottom damage whereas the entire bottom section of the longitudinally parabolic bottom (line C) is susceptible.

Figure 2:
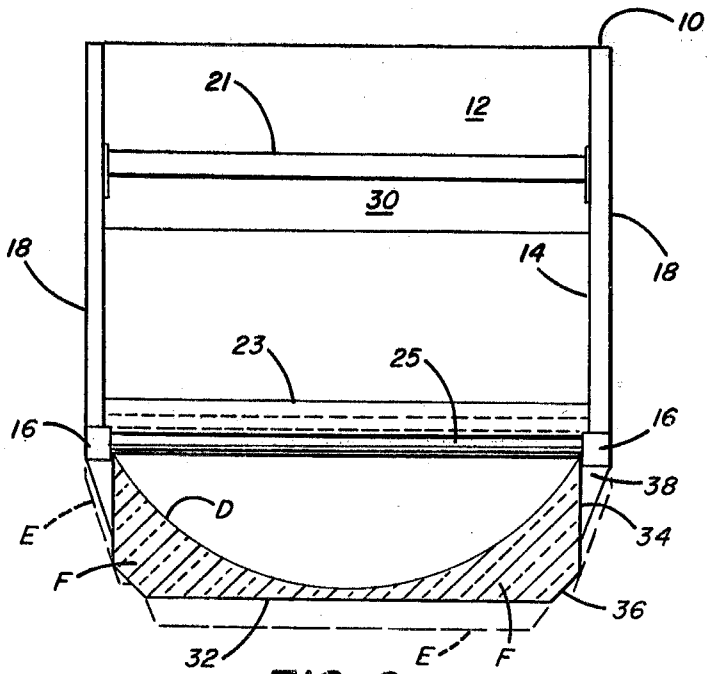
FIG. 2 is a sectional elevation of the gondola of FIG. 1 taken at line B—B.

The increased capacity of the gondola 10 over prior art gondolas is apparent from an inspection of FIG. 2. Line D represents the shape and relative size of a longitudinally parabolic bottom sheet at a similar location on a prior art gondola of comparable size having a longitudinally parabolic bottom. Line E represents the maximum Car Clearance Profile Dimensions established by the AAR. The cross section of the transversely parabolic bottom, comprising the transversely parabolic bottom sheet 32, wall member 34, and bevel member 36, more closely approximates the profile of line E than the longitudinally parabolic sheet represented by line D. This increased capacity appears as the cross-hatched area F. Although area F represents the maximum difference in cross-sectional areas and cross sections taken at other points would show the longitudinally parabolic bottom to have a greater cross-sectional area (for example, at a cross section taken at the location of the floor support member 23), a gondola with the two transversely parabolic bottoms has the greater capacity. In other words, in FIG. 2, the shaded area F represents the optimum increase in capacity; however, while cross sections taken elsewhere would reflect a lesser increase in capacity the cumulative effect of the transverse floor is an increase in capacity. When the space below the side sills 16 is measured, a gondola equipped with a transversely parabolic bottom has a capacity approximately six percent greater than a similar size gondola equipped with a longitudinally parabolic bottom. Further, it is known that the theoretical car failure for a columnar load occurs along the transverse width of the car. The car sides restrict failure in a vertical direction and therefore the applied load causes the side sills to bow inward or outward or, as stated, along the transverse width. In the preferred embodiment the cross ridge member 23 provides inherent reinforcement in the area to strengthen the car against columnar load failures. This reinforcement is further increased in the preferred embodiment by the shape of the connections between plates 32 and cross ridge member 23 which forms an angular configuration.

Therefore, a gondola having the transversely parabolic bottom of the subject invention will have a greater capacity, greater stability due to a lower center of gravity, and a lesser susceptibility to bottom damage than prior art gondolas.

I claim:

1. A gondola-type railway car comprising:

(a) an upper body, said upper body including a pair of side sills which extend the length of said car, one on each side thereof; a plurality of side panels attached to and extending generally upwardly from each side sill; a pair of downwardly sloping end plates, each extending transversely across said upper body between said side panels and located at an end of said car;

(b) a pair of truck assemblies, each attached at an end of said car to the upper body and positioned below said side sills;

(c) a transverse center cross ridge member extending transversely across said upper body and located midway between said end plates; and (d) a doorless bottom member extending below said side sills and including at least two bottom sheets, each having a parabolic shape taken in a vertical plane parallel to the length of said car and attached at an edge to said end plate at a position near the end of the car and at an opposing edge to said transverse center cross ridge member; two pairs of wall members, each said wall member attached to and extending downwardly between one of said side sills and an edge of said bottom sheet.

2. The gondola-type railway car of claim 1 wherein each said wall member includes a plurality of bottom stiffeners attached to and extending downwardly from said side sills and terminating above said bottom sheet.

3. The gondola-type railway car of claim 1 wherein said transverse center cross ridge member has a rhombic-shaped cross section and is positioned so that at least one face of said cross ridge member has an angle to the horizontal similar to the angle of the end of said bottom sheet adjacent thereto.

4. The gondola-type railway car of claim 1 wherein each said bottom member includes two pairs of bevel members, each said bevel member attached to and extending downwardly from one of said wall members to one of said bottom sheets in a plane skew to the plane of said wall member.

5. The gondola-type railway car of claim 1 wherein each said bottom sheet extends at least 32 inches below the bottom of said side sills.

* * * * *